United States Patent [19]

Hunt et al.

[11] Patent Number: 4,583,331

[45] Date of Patent: Apr. 22, 1986

[54] FRAME SUPPORTED STRUCTURE WITH TENSIONED FABRIC PANELS

[75] Inventors: Rowland D. Hunt; Kenneth Gardner, both of Santa Barbara, Calif.

[73] Assignee: Clamshell Partners Ltd., Santa Barbara, Calif.

[21] Appl. No.: 565,854

[22] Filed: Dec. 27, 1983

[51] Int. Cl.[4] ..... E04B 1/347; E04F 10/02

[52] U.S. Cl. ..... 52/2; 52/63; 52/71; 52/90; 135/102; 160/394

[58] Field of Search ..... 52/63, 86, 71, 745, 52/646, 90, 94, 2, 639, 643, 299; 135/102–106, 905; 160/395, 394

[56] References Cited

U.S. PATENT DOCUMENTS

| | | | |
|---|---|---|---|
| 651,251 | 6/1900 | Karr | 52/90 |
| 1,197,739 | 9/1916 | Hutchins | 52/732 |
| 2,330,819 | 10/1943 | Faure et al. | 52/263 |
| 2,461,916 | 2/1949 | Omar | 52/71 |
| 2,856,941 | 10/1958 | O'Neal | 135/102 |
| 2,986,150 | 5/1961 | Torian | 52/63 |
| 3,184,012 | 5/1965 | Fujishima et al. | 52/646 |
| 3,222,841 | 12/1965 | Lipof | 160/394 |
| 3,424,179 | 1/1969 | Minot | 52/63 |
| 3,469,587 | 9/1969 | Folkes | 135/103 |
| 3,791,077 | 2/1974 | Ventimiglia | 135/905 |
| 3,899,853 | 8/1975 | Wertman | 135/102 |
| 4,036,244 | 7/1977 | Huddle | 52/63 |

FOREIGN PATENT DOCUMENTS

| | | | |
|---|---|---|---|
| 892579 | 1/1944 | France | 52/745 |
| 913111 | 5/1946 | France | 52/90 |

OTHER PUBLICATIONS

Trox Manufacturing Publication dated May 22, 1962, 4 pages, Trox Manufacturing Co., 18 Angel Street, Battle Creek, Michigan.

*Primary Examiner*—James L. Ridgill, Jr.

[57] ABSTRACT

A frame supported structure with fabric panels is formed from a plurality of spaced arched frame members pivotally attached at their lower ends to ground plates. The ground plates are fixed in position prior to erection of the frames. The frames have open slots on each side into which slide beaded or roped edges of the fabric panels. The frames can be erected from or near ground level, and then the fabric panels pulled in along the slots, from ground level. Cranes or scaffolding are not required. After the panels are in position they are tensioned, as by inflating inflatable sections extending for the length of a panel.

43 Claims, 27 Drawing Figures

FRAME SUPPORTED STRUCTURE WITH TENSIONED FABRIC PANELS

This invention relates to frame supported structures with tensioned fabric panels and is particularly concerned with such structures which are readily erected and taken down, for example for short term or mobile shelter and storage.

It is well known to provide structures which have spaced rigid frames, forming arches, with spaces between frames filled by fabric. Such structures suffer from various disadvantages. Typical examples are heavy steel structure of frames requiring bolting in place, followed by application of fabric; need for cranes to assemble and bolt frames together; time required to erect; vulnerability during erection; danger to staff erecting structure—high in air—intensified in windy, cold and similarly inclement weather.

In one known form, rigid frames are first assembled and erected by cranes, on fixed ground support positions, and then fabric applied. The fabric is either in one large member or in separate panels. The fabric is tensioned by catenary cables in the lower edge of the fabric, a cable between each adjacent pair of frames. A considerably amount of loose fabric can be in position during final assembly and this can be very dangerous in high winds.

In another form of structure, rigid frames are assembled and erected, with cranes. The bases of the frames are attached to ground supports in a manner which allows lateral movement. A fabric panel is connected between adjacent frames and tensioned by lateral movement of a frame, to increase the distance between frames. Thus, as an example, a first frame is firmly fixed at its base and the next frame moved sideways to tension the fabric. The base of this frame is then fixed. The third frame is erected, the next fabric panel installed and the frame moved to tighten the fabric. This is repeated successively for all the frames. It will be appreciated that ground supports can only be finally positioned as frames are erected and panels tensioned.

In both examples, assembly and erection is lengthy, requires cranes and/or scaffolding, and can be dangerous and vulnerable during erection.

The present invention provides a structure in which the frames are all preassembled on the ground and are mounted on ground supports which are pre-located and fixed prior to assembly and erection of the frames. The frames are then erected and locked in position. The spaces between frames are filled by panels of fabric. The panels may be inserted at the bottom ends of the frames and pulled up into position by ropes extending in keyhole or the like slots along the edges of frames. The panels have beaded or roped edges which slide in and are retained in the keyhole slots. After installation of the panels, the panels are tensioned. The frames are pivotally attached at the bottom ends to the pre-fixed ground supports, and when all are assembled, on or near the ground, and pivotally attached to ground supports, they are pulled upwards by pulling on a rope or cable, at ground level. Spacers are pivotally connected between frames, also while the frames are on the ground. Thus the whole frame assembly is assembled at or near ground level and then pulled up, also from ground level. The panels are inserted and pulled into place again from ground level, and tensioning is done at ground level. The structure can also be lowered and disassembled at or near ground level. A convenient way of tensioning panels is to form tubular members or sections, extending the length of a panel and inflating the tubular members after installation.

Various other advantages and features will be appreciated and the invention readily understood from the following description of the broad and general arrangement and assembly method, together with various modifications and variations, in conjunction with the accompanying drawings, in which.

Figure 1:
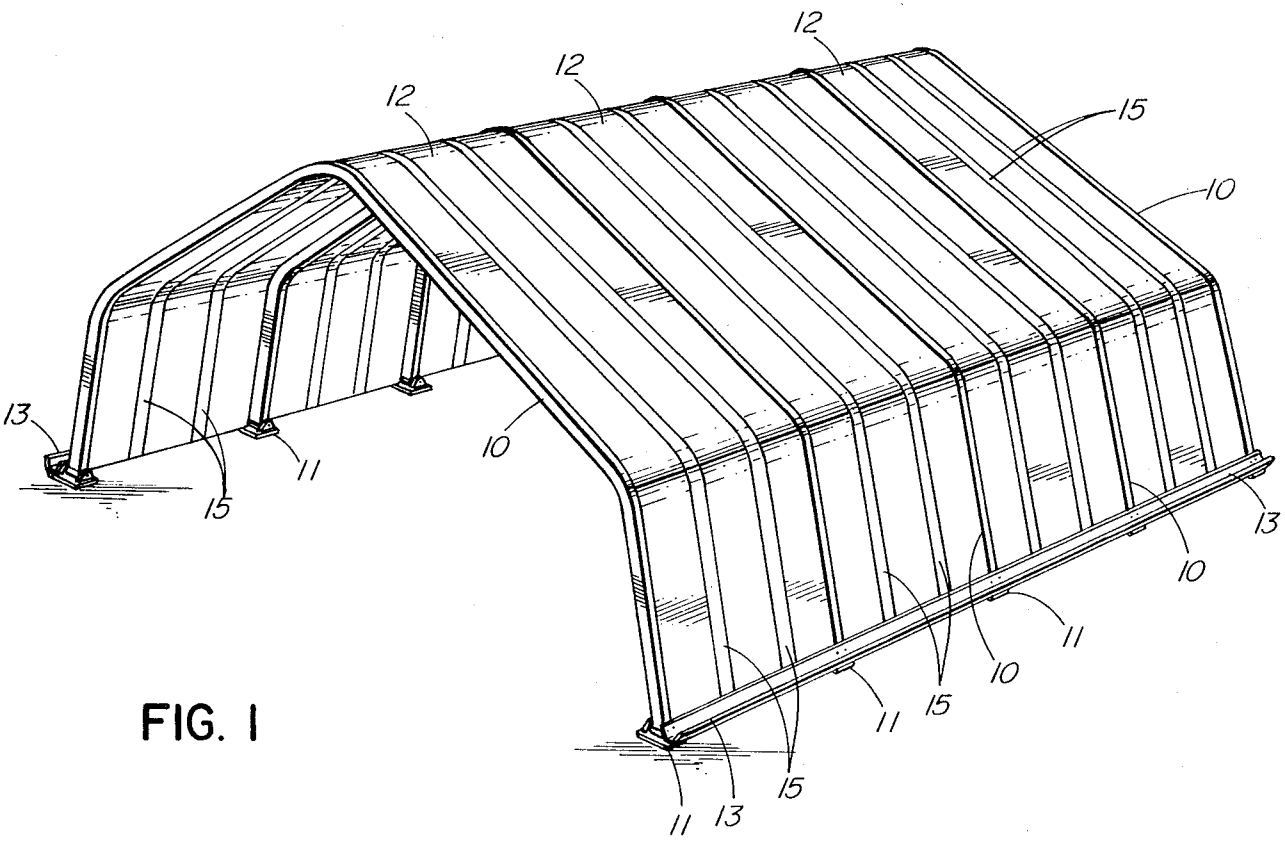
FIG. 1 is a perspective view of an erected building.
Figure 2:
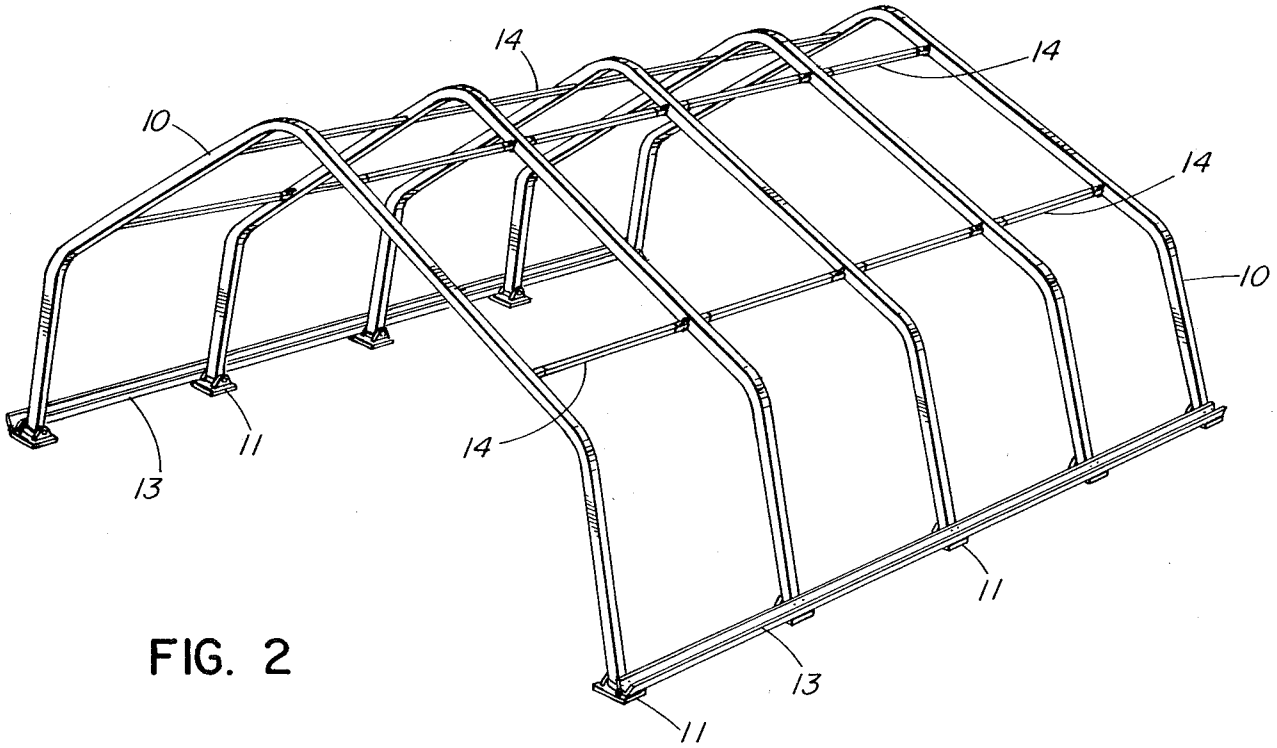
FIG. 2 is a perspective view of the building of FIG. 1, with fabric panels omitted.

FIGS. 1 and 2 illustrate generally a building formed from a plurality of spaced parallel frames or arches 10 attached at their ends to ground plates 11. The ground plates are firmly fixed in position, as will be described later with respect to FIG. 3. The ends of the frames are pivotally attached to the ground plate, as described with respect to FIGS. 3, 4 and 5. The spaces between the frames 10 are closed by fabric panels 12. Along the lower edges of the fabric panels extend rain gutters 13. The spacing of the frames is defined by spacers, seen at 14 in FIG. 2. The spacers are pivotally attached to the frames, for reasons explained later.

The building illustrated in FIGS. 1 and 2 is seen without end closures. These can be provided, as required, in a variety of forms. The panels have tubular members or portions 15 which extend from one lower edge of a panel to the other lower edge. These tubular portions can be inflated when the panels are in position to tension the panels.

Figure 3:
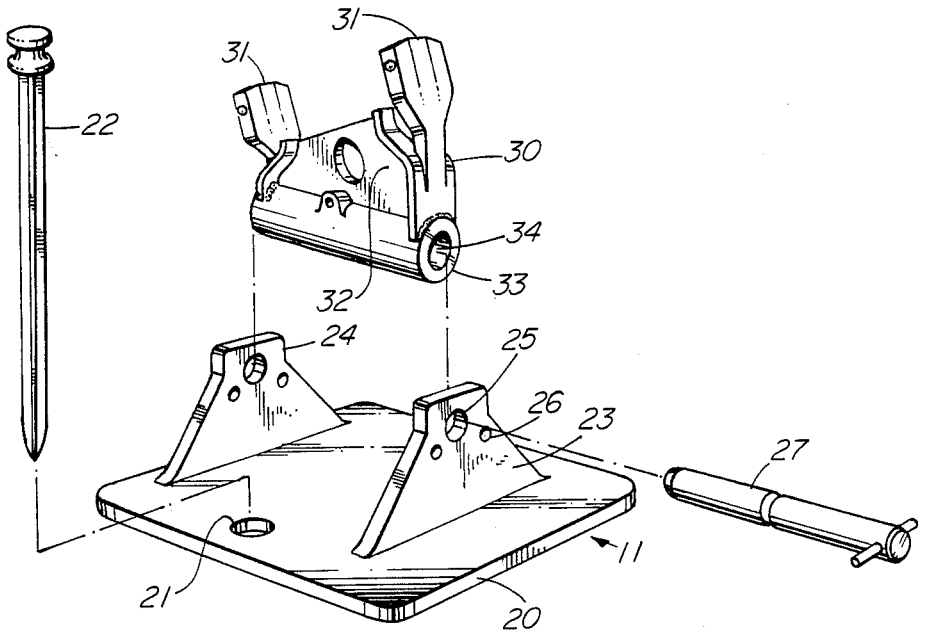
FIG. 3 is a perspective exploded view of a ground plate and a hinge member as provided at the lower ends of each frame.

FIG. 3 illustrates in more detail a ground plate 11 and hinge member. The particular form of ground plate shown has a flat base member 20, in the example being of rectangular plan form and having a hole 21. A pin 22 is driven down through each hole 21 to fix the ground plate firmly in position. Extending up from the base member 20 are two spaced parallel, webs 23 and 24. A hole 25 is formed in each web, the holes axially aligned. Two further holes 26 are formed in web 23 adjacent the top corners. A pin 27 is a fit in the holes 25. Each hinge member 30 has two spaced parallel extensions 31 which fit into receiving formations in the frames. The extensions are joined at their lower ends by a web 32 which in turn is joined to a tubular section 33. The tubular section 33 fits between the webs 23 and 24 (FIG. 3) and the bore 34 of this section is a pivotal fit on the pin 27.

Figure 4:
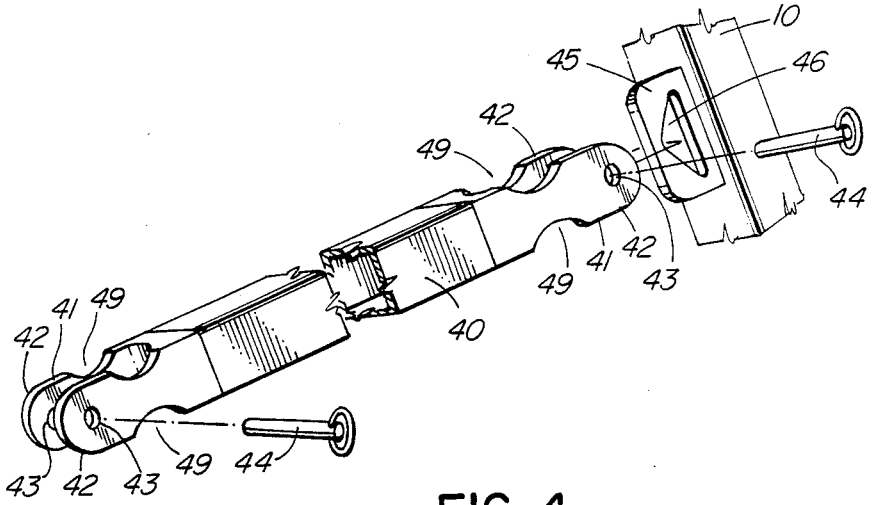
FIG. 4 is a perspective view of a spacer.

FIG. 4 illustrates a spacer 14. In the example, a spacer comprises a tubular main portion 40 into each end of which is fitted a pivot member 41 which has two parallel, spaced, legs 42, each having a hole 43, the holes 43 being in alignment for reception of a pin 44 which connects the spacer to a frame 10, via a bracket 45, attached to the frame. The bracket 45 has a slot 46, through which passes the pin 44. The slot provides for some sliding of the pin during erection. It is only possible to have fixed pivotal joints if all pivots are on the frame center line.

Figure 5:
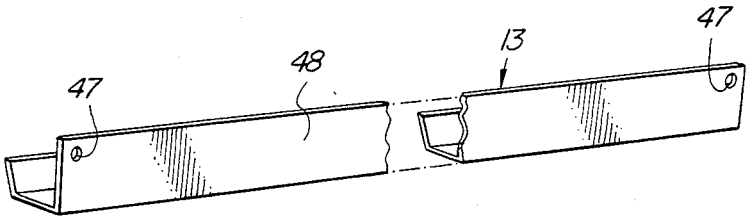
FIG. 5 is a perspective view of a rain gutter and base spacer.
Figure 6:
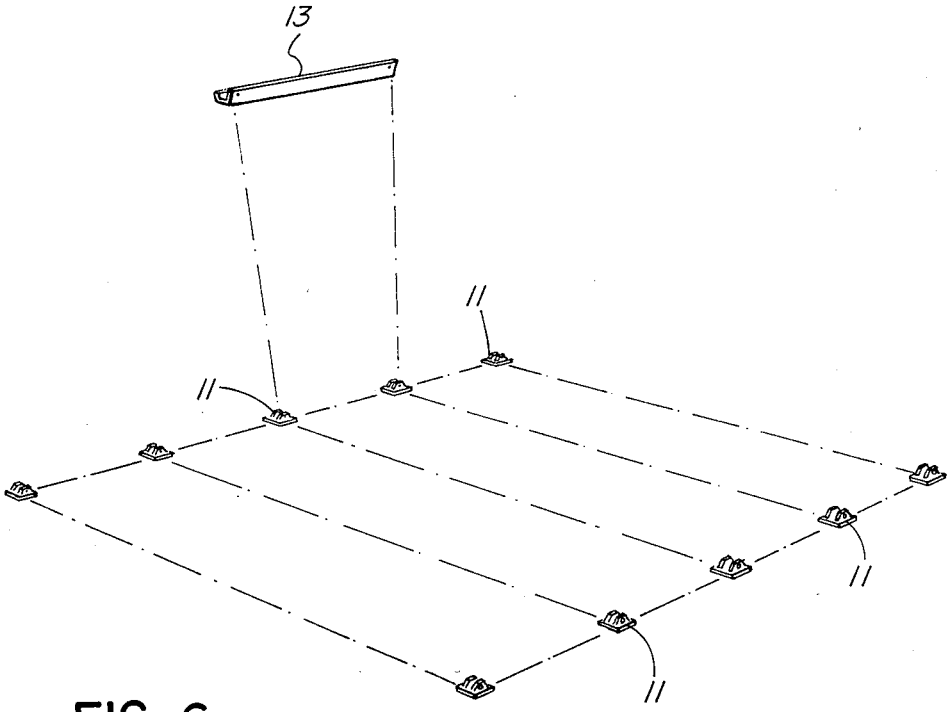
FIG. 6 is a perspective view of a first stage in building erection, showing ground plates or base hinge members in position.

FIG. 5 illustrates in more detail a bottom or base spacer 13 which can also act as a rain gutter. The gutter is basically of channel shaped cross-section with a hole 47 at each end of the back or inner wall 48. The holes 47 provide for connection of the gutter to the ground plates 11 by means of the holes 26 in the webs 23 and 24 of the ground plates.

FIGS. 6 to 12 illustrate various stages in erecting a building. It should be emphasized as previously stated, all the erection can be done at or near ground level, without the use of scaffolding or cranes. Assuming the site has been selected, the ground pates are first positioned on the ground, using a wire template or other device to ensure correct spacing of the ground plates, both as to distance apart along and across the building and to squareness of the building. The rain gutters are positioned and attached and this provides also for correct spacing of the ground plates. The ground plates are fixed in position by driving in the pins 22. The frames 10 are assembled and pivotally attached to the ground plates. In the example, a frame comprises four straight sections with curved sections joining the straight sections, the joins indicated at 50. However the form of the frames can vary, and will normally be varied, as by insertion of additional straight sections, for varying the span and/or height. The final, erected, position of a frame is indicated by dotted lines 10*a* illustrated in FIG. 7.

Figure 8:
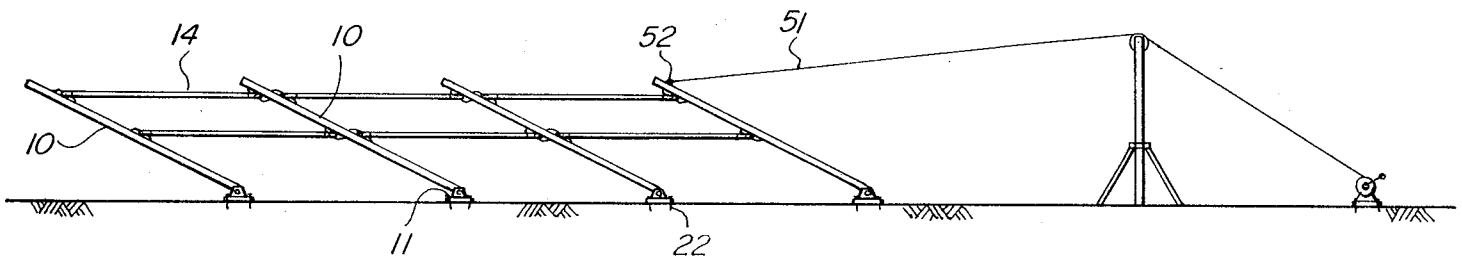
FIGS. 8 to 12 are side views illustrating successive stages in erection.

After attachment of the frames, the spacers 14 are installed. If the spacers were pivotally attached to the frames on the center lines of the frames, simple pivot joints could be used. However, as will be appreciated from FIG. 4, the attachment positions are not on frame center lines and some relative motion between spacer ends and the mounting bracket is required. This is described in relation to FIG. 4 earlier. Also, depending upon the section of the frame, it may be necessary to provide other clearances. Thus, with a section as in FIG. 13, it is necessary to provide some clearance for the flanges 61 and 62. Even with some clearance, provided by recesses or grooves 49 in the members 41, it will normally be advantageous to raise the frames slightly to ease assembly of the spacers. This is as illustrated in FIG. 8. A rope or cable 51 is attached to the top of a first frame, at 52.

Figure 9:
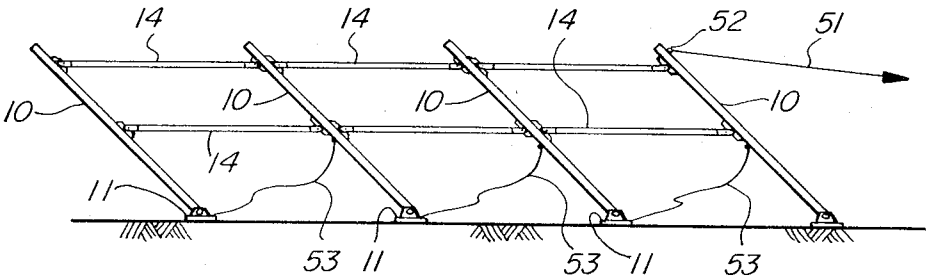
Figure 10:
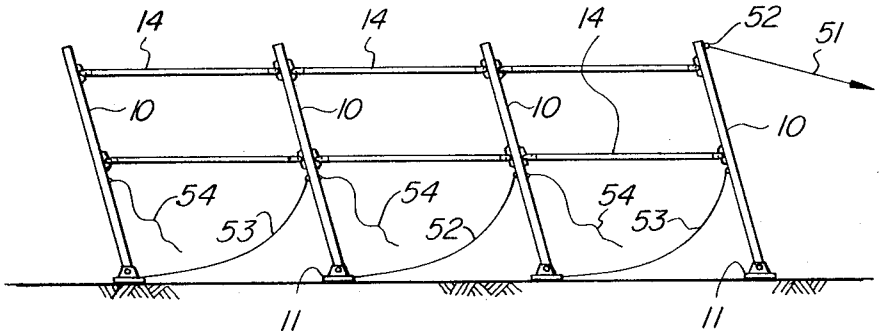
Figure 11:
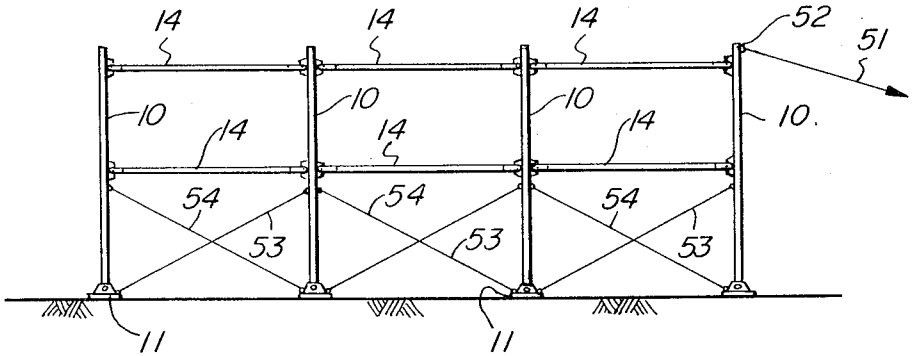

By pulling on the cable, at ground level, the frames 10 can be caused to pivot upwards about the pivotal attachment to the ground plates. Three stages of upward movement are illustrated in FIGS. 9, 10 and 11. The final rigidity of the frames is obtained by cross-bracing wires or cables. A pair of cross-bracing wires cross each other on each side between each pair of frames. One of each pair of wires can be installed prior to erection, and these are indicated at 53 in FIGS. 9 and 10 and also in FIG. 11. The other wire of each pair is attached only at one end initially, as seen at 54 in FIG. 10. When the frames are fully erected, wires 53 will be taut, or nearly so. The wires 54 are then completely attached. The wires 33 and 54 are attached at their upper ends to the arches and at their lower ends are attached to the ground plates, typically by means of the holes 26 in the web 23 (FIG. 3). The rain gutters 13 also act to transmit end loads from frames as they are erected, thus spreading erection loads.

If desired turnbuckles can be provided in the wires 53 and 54 to tighten the wires and also ensure that the frames are vertical.

Figure 7:
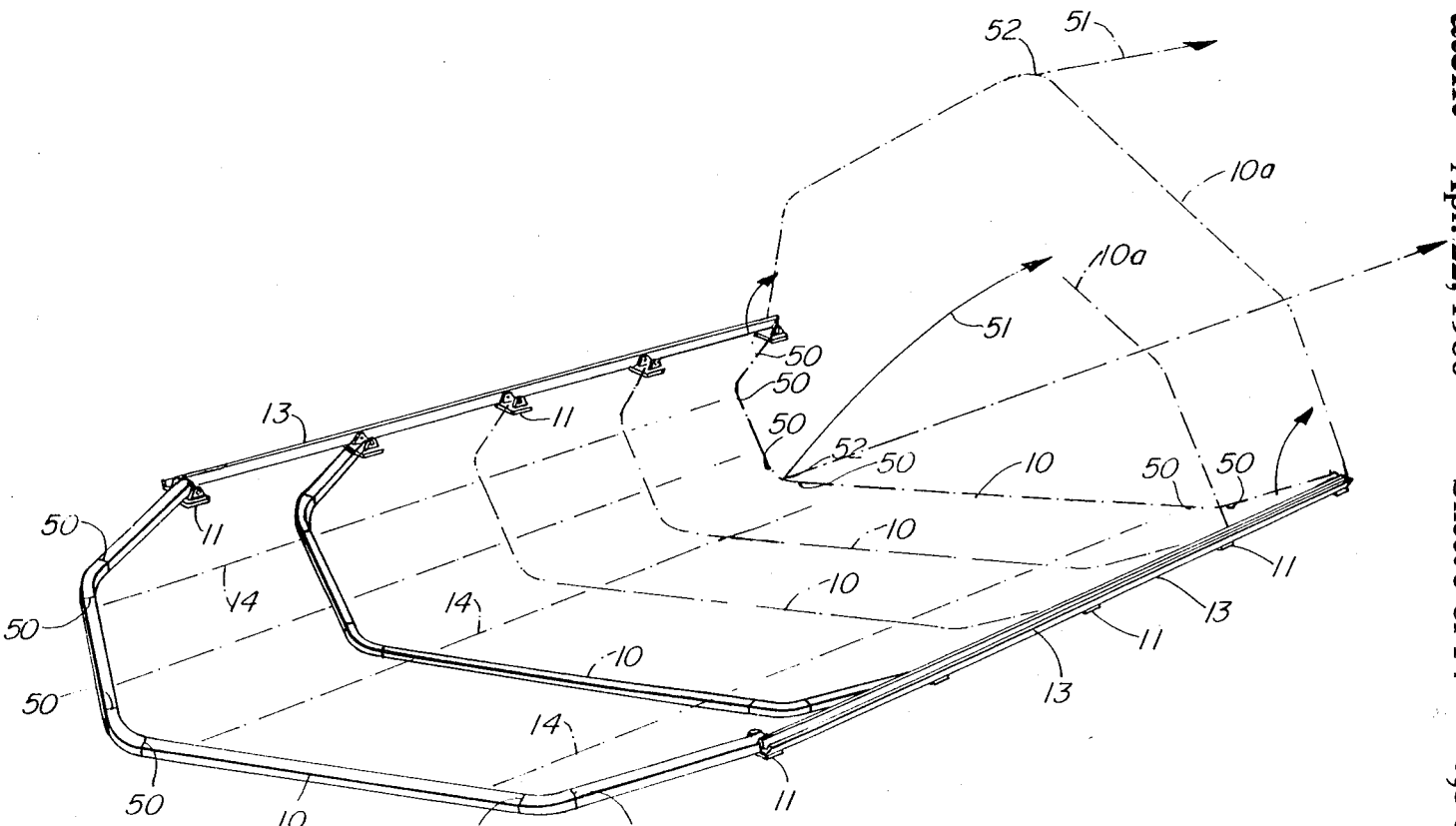
FIG. 7 is a perspective view showing frames positioned and attached to ground plates.

There can be a considerable variation in the particular form of a frame. The example as illustrated in FIG. 7, as described above, has four straight sections joined by three curved sections. It is possible to provide different lengths of straight section, to vary the span and/or height of a frame. It is also possible to form the bends or curved sections with straight sections integral therewith. For very large frames, it is desirable that it be capable of being broken down into sections which can be lifted easily by two persons, and in fact this lifting facility is desirably applicable to all sizes of frame.

Figure 12:
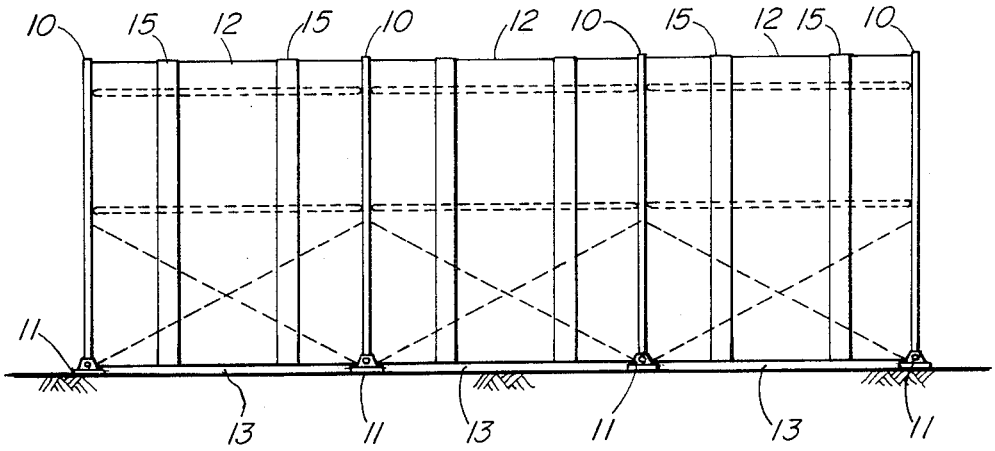

After the frames are in the fully erected position and stabilized by the cross-bracing wires 53 and 54, or other means, the fabric panels are put into position, as illustrated in FIG. 12. A convenient way of doing this is to provide the side edges with a beaded edge as by folding the edges over a rope or similar member and fastening. The frames are then arranged to have a form such that grooves are provided for the edges of the fabric panels to slide in.

Such an arrangement is similar to that used for attaching the edges of sails to masts and booms of sail boats.

Figure 13:
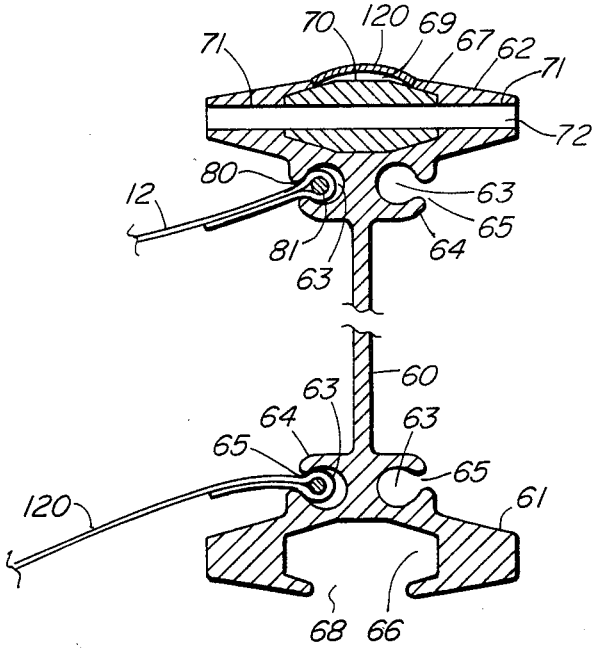
FIG. 13 is one cross-sectional form of a frame.

FIG. 13 illustrates one convenient form of frame transverse cross-section. The cross-section is in the form of an I, having a central web 60 and inner and outer flanges 61 and 62. At each end of the web 60, at the junctions with the flanges 61 and 62, two parallel grooves 63, conveniently of circular cross-section, are formed, by walls 64. The walls 64 have a narrow slot 65. The frames can be formed, for example, from aluminum extrusions.

The flanges 61 and 62 are shaped to provide slots or channels 66 and 67 respectively. The channels enter into each leg of the flanges and also open through the end wall at 68 and 69. The cross-section of the frames, as illustrated in FIG. 13 is an example only, and other cross-sections can be used. For example, the grooves 63 can be moved outwardly, nearer to the outer ends of the flanges 61 and 62. The section is convenient in that it can be extruded, for example in an aluminum or aluminum alloy material. The various particular parts of the section, grooves 63 and transverse channels 66 and 67 for example, provide for particular uses.

As an example, adjacent sections of a frame can be joined by a plate, or similar member, inserted into the outer channel 67. This is illustrated in FIG. 13, the plate indicated at 70. The frame section is drilled in the outer flange, at 71, and one or more pins 72 driven through the holes 71 and through corresponding holes through the plate 70. The plate can extend either side of the joint line for a desired distance, for example 9".

Figure 14:
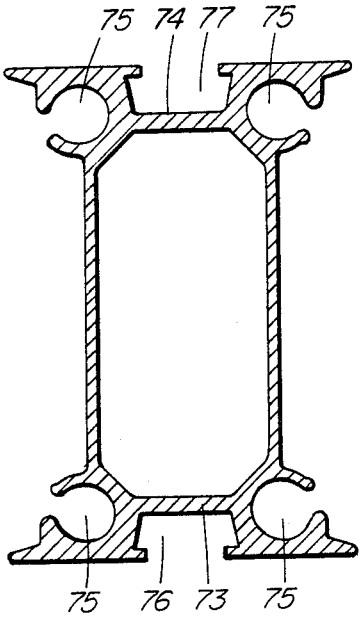
FIGS. 14 and 15 illustrate two alternative cross-sections for a frame.
Figure 15:
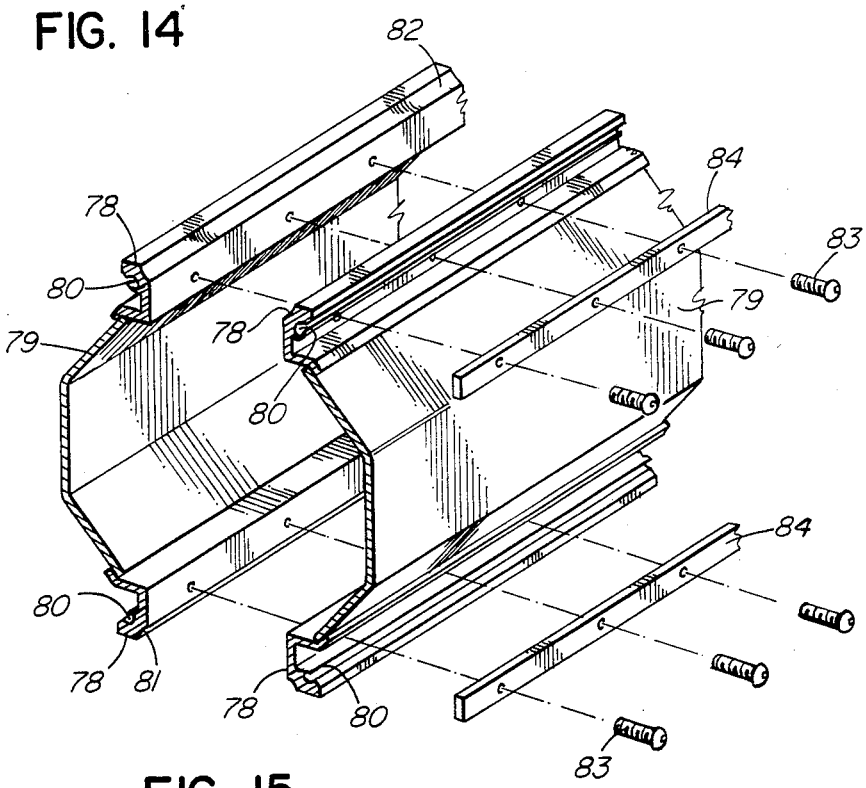

FIGS. 14 and 15 illustrate alternate forms of frame. In FIG. 14 the frame has a cross-section which, at its inner and outer walls 73 and 74, has grooves 75 which correspond to grooves 63 of FIG. 13. Also there are channels 76 and 77 corresponding to channels 66 and 67 of FIG. 13. FIG. 15 illustrates a structure for the frame in which channel shaped members are connected together to form a hollow, box-like cross-section. Each channel-shaped member comprises a formed top and bottom rail 78, conveniently extruded, welded to the opposite edges of a web member 79 which is in the form of a shallow trough. The rails have grooves 80, corresponding to grooves 63 of FIG. 13 and grooves 75 of FIG. 14. Also, when the channel shaped members are connected together, channels 81 and 82 are formed, corresponding to channels 66 and 67 of FIG. 13. The channel shaped members are connected together by screws 83. Normally the channel shaped members are offset or staggered so that joints on one side of a cross-section do not correspond with the joints on the other side of the cross-section. If desired strengthening or connector strips 84 can be provided. The length of the strips 84 can vary, extending for a short distance either side of a join, or extending to be contiguous and forcing a strengthening member.

The structure of FIG. 15 is particularly useful for frames requiring a large cross-section, such as for frames used to build structures having a very wide span. The individual channel shapped members can still be of a weight which can be lifted by two persons. Also, the members will nest when stacked, for maximum use of storage and shipping space. It will be necessary to provide short lengths for the ends of frames and at the joins with curved sections, although it is possible to have the curved sections of a similar form and provide for the offset or staggered joins.

Figure 16:
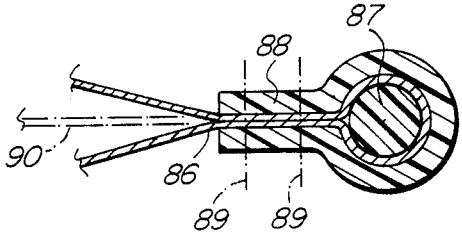
FIG. 16 is a cross-section through one edge of a panel illustrating the structure thereof.

The fabric panels 12 are retained in the grooves 63 by being provided with beaded or roped side edges. FIG. 16 illustrates an edge of a panel in section. A length of material 86 is wrapped around a flexible core, such as rope or cable 87, and a length of webbing 88 is wrapped over the material 86. A row of stitching is done close to the rope or cable 87 and a further row of stitching applied spaced from and parallel to the first row. These rows are indicated at 89. The material of the panel, indicated at 90, is positioned between the edges of the material 86 and attached thereto, as by welding and/or stitching. Typical materials are polypropylene rope at 87, PVC coated fabric at 86 and a polypropylene webbing at 88. The webbing reduces friction and improves wear qualities, adds strength to take the loads applied in pulling in a panel—generally arising from friction, and forms a porous surface to accommodate any grit lodged in grooves and reduce scratching. The thicknesses of the materials, and webbing, have been exagerated in FIG. 16, for clarity.

Figure 17:
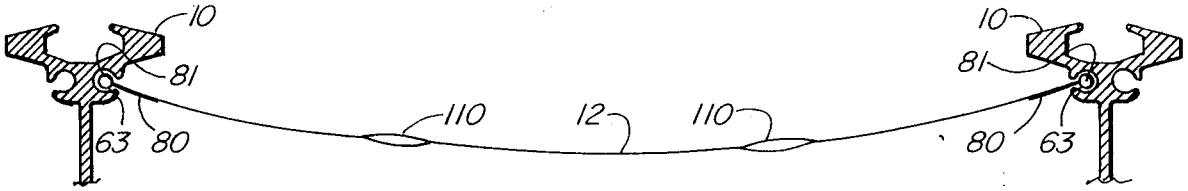
FIG. 17 is a cross-section through a fabric panel in an untensioned state.
Figure 18:
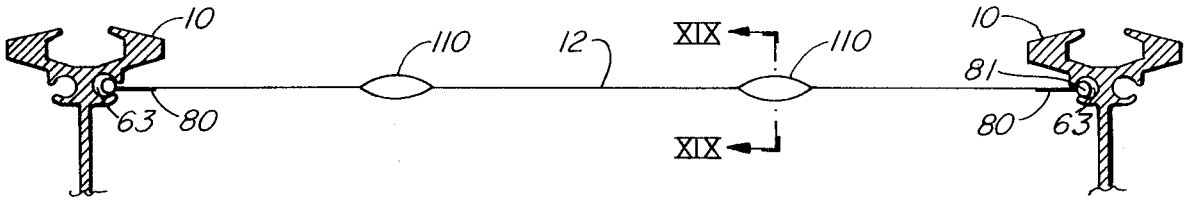
FIG. 18 is a cross-section as in FIG. 17, with tubular portions inflated to tension fabric panels.
Figure 19:
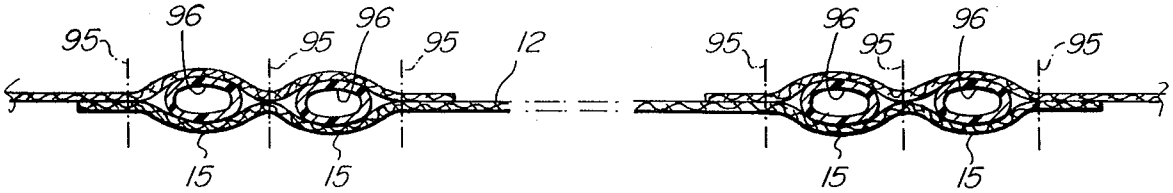
FIG. 19 is a cross-section, as on the line XIX—XIX of FIG. 18, illustrating one form of inflatable tubular portion.

FIGS. 17 and 18 illustrate the tensioning of a fabric panel. Initially the panel is pulled into position with a certain amount of slack. At one or more positions in a segment, tubular sections are formed. In FIGS. 18 and 19 two such tubular sections, 110, are provided. Various ways of forming the tubular sections can be used. When the fabric panels are in place, the tubular sections 110 are inflated, as in FIG. 18. This tensions the panel 12 and the tension in the panel can be adjusted by the degree of inflation, and inflation pressure, of the tubular sections 110.

FIG. 19 illustrates a particular way of providing the tubular sections. The panel 12 is formed, in the example, from three strips or sections, welded together with the side edges overlapping. The welds, indicated at 95 are spaced apart and thus form the tubular sections 110, extending the length of the panel. In the so-formed tubular sections are inserted tubes 96 of flexible material. The tubes are closed at each end and provided with a valve or similar means for inflation, at one or both ends. By using separate tubes these can be made seamless and reduce chances of leakage. Conveniently two tubular sections are formed side-by-side at each overlap of panel sections. This increases the amount of slack which can be accommodated, and also can be used to provide some spare capacity in the event that one tubular section becomes deflated. A variation is to form a panel of two sheets of material superposed, and to weld, or stitch the whole panel so as to form a complete array of contiguous parallel tubular sections extending the length of a panel. A further form is to join two panels of materials at their side edges, with a roped edge at each side, and provide one or more tubes between the panels. In such a structure the outer panel could be the major strength and weather proof layer and the inner panel could be for insulation or black-out purposes. Conveniently a tube could be provided adjacent each edge, to give maximum tensioning. It would also be possible to tension by providing flaps with grommets and using lacing to pull the flap together, but this would require climbing up to the top of the structure. A sliding zip fastener means could also be used. If desired, the roof panels could be separate from wall panels to accommodate varying spans for example. The panels could be joined at the junctions of roof and walls by zip fasteners or other means. The tensioning of roof panels could be by a different structure to that used for the walls and could provide for different levels of tensioning. It is desirable to permit some slight sagging of panels under load as this considerably reduces loads at the edges of the panels, for example, under snow and wind loads. This can be obtained by some slight stretch in the fabric, or by the deformation of the inflatable portions when used, or by a combination of both.

Figure 20:
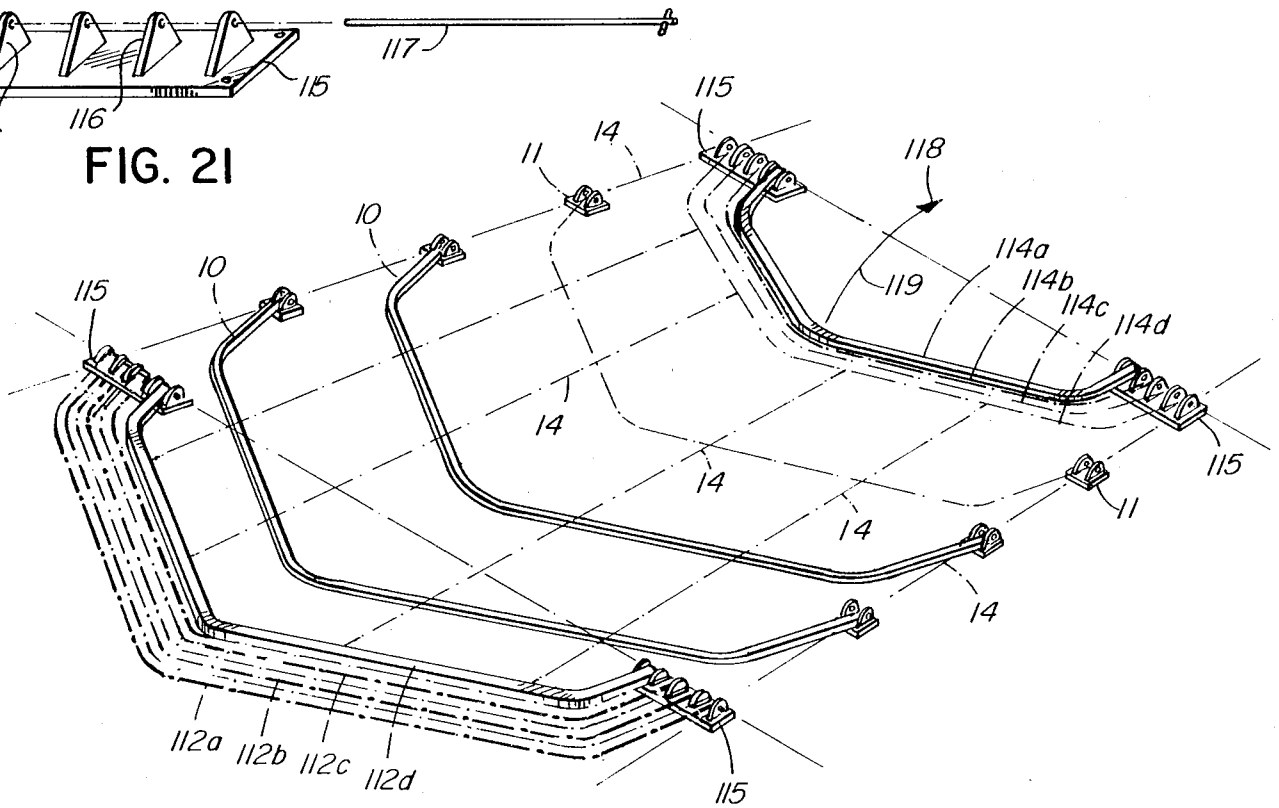
FIG. 20 is a perspective view of frame arrangements for end closures.
Figure 21:
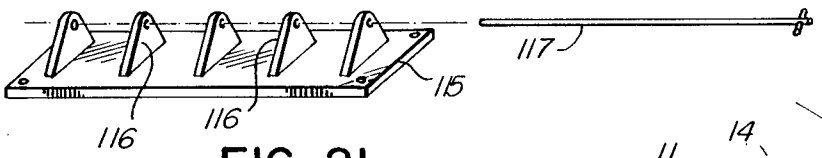
FIG. 21 is a perspective view of a ground plate or base member for the end closure frames of the arrangement in FIG. 20.

Various forms of end closure can be used, the end closures also serving as doors in certain conditions. FIG. 20 illustrates one form of end closure in which a series of "nesting" frames are used. FIG. 20 illustrates a complete structure, with three main arches or frames 10 shown, for the main body of the building. At each end are a series of arches or frames, four in the present example and indicated at 112*a, b, c* and *d* and 114*a, b, c* and *d*. The frames at each end nest and are assembled on the ground, being pivotally attached at their ends to common base plates 115. The base plates 115 differ from base plates 11, in that there are a number of spaced apart webs, with each frame end positioned between a particular pair of webs. FIG. 21 illustrates one form of base plate. Thus for four frames, five webs 116 are provided, with a pin 117 passing through all the webs and the frame ends.

Figure 22:
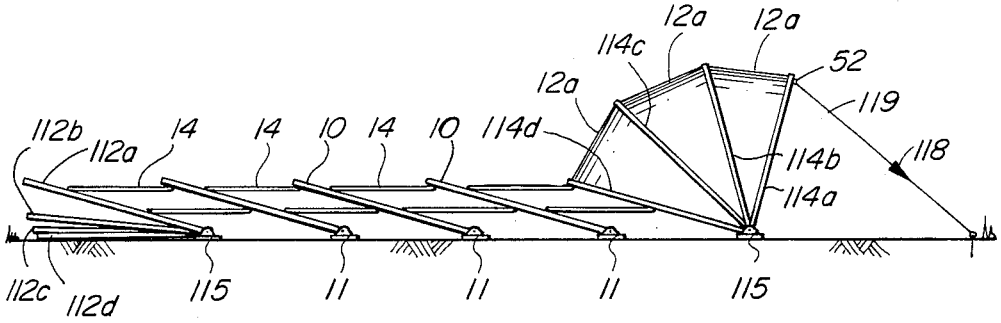
FIGS. 22, 23 and 24 are side views illustrating the erection of an end closure as in FIG. 20.
Figure 23:
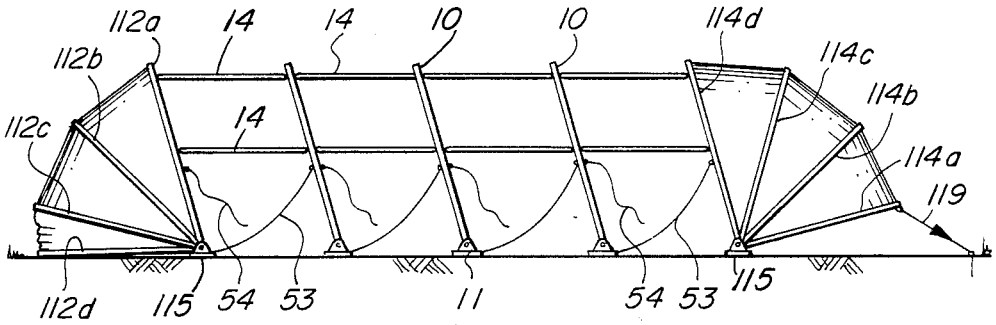
Figure 24:
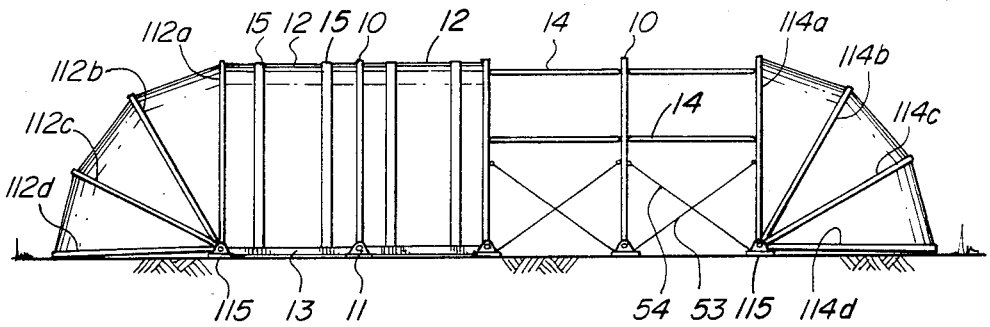

The erection of a building or structure with end frames as in FIG. 20 is very similar to the erection as illustrated in FIGS. 10, 11, 12 and 13. Considering FIG. 20, the structure is created by pulling as indicated by arrow 118, on a rope 119 attached to the frame 114*a*. The end frames 114*a, b, c* and *d* are first progressively erected and then the main frames 10 start to lift. This is seen in FIG. 22. As the end frames 114*a, b, c* and *d* are progressively pulled they move over and down, the main frames moving up and the other end frames 112*a, b, c* and *d* are pulled up. This is illustrated in FIG. 23. Spacers 14 are positioned between the main frames, and also the diagonal bracing wires 53 and 54. The fabric is installed between the end frames 112*a, b, c* and *d* and between end frames 114*a, b, c* and *d* before erection takes place or before the end frames are fully erected. In the fully erected condition, the structure is as illustrated in FIG. 24, there being two two fabric panels still to be installed in this illustration.

When finally erected, the main body of the structure is a stable entity because of the diagonal bracing wires 53, 54 and because of the taut fabric panels. The end closures can be opened by pulling up of the end frames. It is arranged that the inner end frames, 112*a* and 114*a* are the ones which rest on or adjacent to the ground. By pulling up on these frames, as by a rope passing up through a loop or ring on each frame 112*b, c* and *d* and 114*b, c* and *d*, the frames pivot up and nest. One or both ends can be arranged to open. It is also possible to provide such an end closure with the end frames increasing instead of decreasing, as in FIG. 20. Then, for opening, the frames nest one outside the next instead of inside.

The advantage of the arrangement of FIG. 20 is that the end closures can be preassembled on the ground before erection. However, there are also disadvantages. Thus the end arches are all different in size, and special base plates are required. With decreasing arches or frames, the door opening is narrower than the rest of the structure. An alternative way is to use the same frames or arches for the ends as for the main part.

Figure 25:
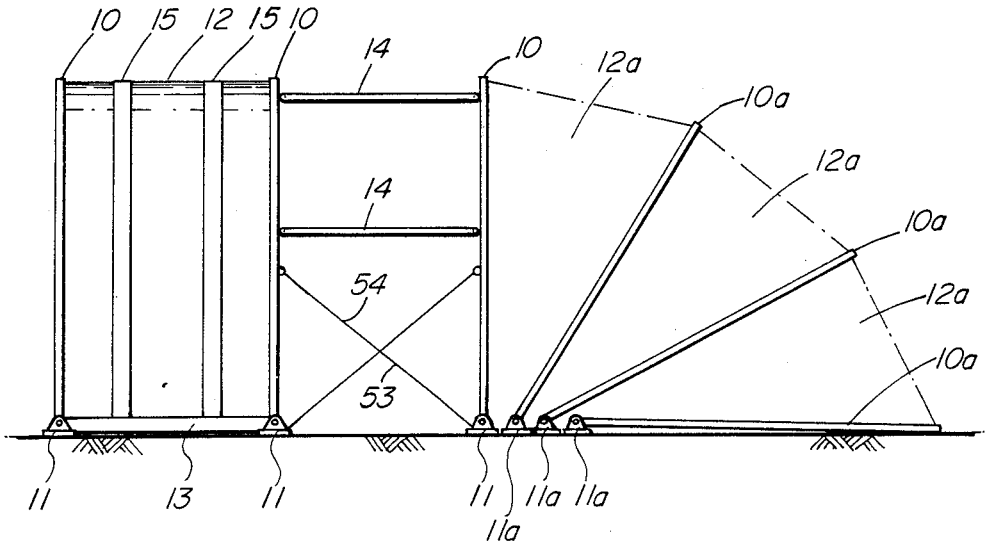
FIG. 25 is a side view of an alternative form of end closure.

FIG. 25 illustrates one form of end closure using common frames or arches. The frames are the same size and form as for the main portion of the structure, being indicated at 10*a* for the end structure. Similarly, the same form of base plates are used, being indicated at 11*a*. The base plates 11*a* are spaced apart a distance which is greater than the thickness of the arch cross-section. However, although the base plates 11*a* can be positioned and fixed at the same time as the other base plates 11, the end structure frames or arches 10*a* are erected after the main frames have been erected. The end frames are assembled and attached to their ground plates one at a time, and in sequence. An end frame is assembled, attached to its ground plates, erected in position and then the next end frame assembled, attached and this erected. To open an end the frames are pivotted upwards, as by a rope at the top. Common arch members and full width openings are obtained. The fabric is pulled into position, a panel at a time, and tensioning again can be by inflated tubular portions. The panels are indicated at 12*a*.

The frame cross-section exemplified in FIG. 13 provides several advantages. Liners can be mounted on the frames, using the inner grooves 63, without interfering with the insertion or removal of the main panels 12. Ropes are positioned in the various grooves 63 at the time the arches or frame sections are assembled into complete arches. These ropes will extend from one side of a structure to the other, over the structure top. By this means, the fabric panels 12 are pulled into place in the outer grooves 63. Similarly, ropes in the inner grooves 63 can be used to pull in an inner lining for insulation for example, or for blacking out structure. Inner grooves 66 can be used for positioning partition structures, and other items. Interior lights could also be pulled up into place, and other similar features, by use of the ropes, and avoiding climbing. Dismantling also can be done from ground level, without climbing.

Attachment to the inner groove can be by a nut which is elongate and capable of entering the groove in one direction and is then rotated to extend across the groove, with an inherent jamming effect. The screwing in of an attachment member through the nut would tighten it in place as the end of the attachment member extends into contact with the inner wall of the groove. By having the nut on the end of the attachment member prior to insertion, the nut can be inserted from the ground. The sections illustrated in FIGS. 14 and 15 also enable liners to be mounted on frames without interfering with the main panels. If inner panels, or liners were not required, it is feasible to provide a section having only the outer grooves 63.

The frames can be manufactured to have the same cross-section and form for the whole length for example as on extrusion, the curves being formed as by stretch bending. In an alternative structure, the straight sections are unitary, for example lengths of extrusion, while the curves are fabricated. A fabricated curve would have inner and outer flanges conveniently lengths of extrusion, formed to a curve and then joined by web sections molded to the flanges.

It would also be possible to provide a section which would give additional grooves 63 for attachment of additional panels or for other purposes. Various other modifications of variations of the cross-section of a frame can be readily provided.

Figure 26:
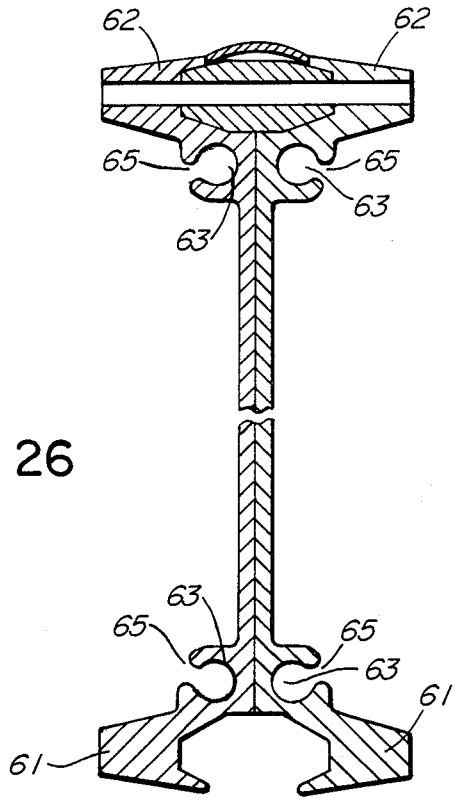
FIGS. 26 and 27 illustrate alternate ways of providing a frame section as in FIG. 13.
Figure 27:
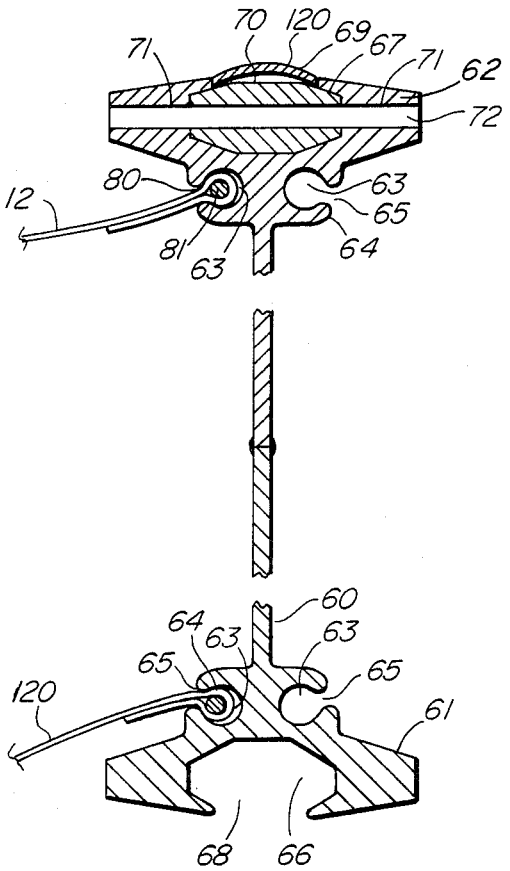

Also instead of the section of a frame being of a unitary form, as for example in FIG. 13, the section can be of two sections comprising inner and outer flanges, the sections welded along the center of the web. Also the section, as in FIG. 13 could be of two channel shaped sections each having half of an inner flange and half of an outer flange joined by a web. The webs would then be welded or mounted or otherwise attached together. These are diagrammatically illustrated in FIGS. 26 and 27.

While snow loadings of a reasonable level, about 40 psf, can readily be accepted, for higher loadings, the building or structure can be pressurized.

It will be seen that a structure in accordance with the invention is very easy and safe to erect. No cranes, scaffolding or similar structure is required. The various items are assembled on or near the ground and erected from the ground. The base plates are firmly positioned before erection and the arches or frames are quickly erected and held in a stable condition. While being erected no fabric is inserted and therefore minimal wind loads are applied during erection. The fabric panels are inserted and pulled into place from the ground, and tensioned without moving the arches or using cables and similar devices. Dismantling is similarly easy and safe, being capable of being done from ground level.

While the erection of a building or structure has been described as from one end, it is very convenient to pull up the frames from a central position. A central king post is provided and the frames assembled with the frames extending away from the king post. Ropes or cables extend from the king post to the top of the first frame on each side of the king post and the ropes or cables pulled together and the frames pulled up at each side of the king post. These ease loads on the king post, but could require someone to climb up and insert spacers between the two inner frames. The spacers can be hinged to one frame before erection and would require pinning to the other frame after erection. For a very long building, more than one king post could be provided along the length of the building and the building erected in several sections. Thus a building could be erected in sections of say five frames, each side of a king post.

What is claimed is:

1. A frame supported structure comprising;

ground plate means extending in two parallel lines to form support surfaces in each line spaced a predetermined distance apart and fixedly fastened to the ground;

a plurality of spaced frames extending up from said ground plate means to form a plurality of arched spans, the frames pivotally attached at their ends to said ground plate means such that said ends are spaced apart by said predetermined distance;

each frame having a transverse cross-section including a web section extending in a direction parallel to the plane of the frame span; a flange at the outer end of the web section extending laterally on each side at the outer end of the web section; and an enclosed groove extending the length of the frame on each side of said web section at said flange, a slot extending through a wall of each groove to provide communication therewith;

a fixed length rigid spacer connected between adjacent frames, said rigid spacer being pivoted to said adjacent frames and having a length equal to said predetermined distance such that said adjacent frames and said rigid spacer form an articulated parallelogram with said ground plate means and such that said adjacent frames can be pivoted about said ground plate means and always remain parallel to each other;

a fabric panel extending between each pair of adjacent frames, each panel including a beaded edge along each side, the beaded edges being positioned in said grooves and the panel extending through said slots;

tensioning means extending lengthwise in each panel and adapted to tension said panels after attachment of said panels to said frames.

2. A structure as claimed in claim 1, said grooves positioned substantially at the junction of said flange and said web section.

3. A structure as claimed in claim 1, said grooves of substantially circular cross-section.

4. A structure as claimed in claim 1, said transverse cross-section of a hollow, box-like section having two spaced parallel webs forming said web section and inner and outer flanges joining inner and outer ends respectively of said spaced parallel webs, and including an enclosed groove at each junction of a flange and a web, the grooves positioned outside said webs.

5. A structure as claimed in claim 1, wherein said ground plate means comprises a plurality of individual ground plates, and including a bottom spacer between adjacent ground plates and attached thereto.

6. A structure as claimed in claim 1, including diagonal cross-bracing wires between adjacent frames.

7. A structure as claimed in claim 1 wherein said panels extend in one unit for the complete span of said frames.

8. A structure as claimed in claim 1, wherein each panel comprises a plurality of separate sections, each section extending for part of the span of said frames.

9. A structure as claimed in claim 1, said beaded edge along each side of a panel comprising a central flexible core, a length of material positioned around said core and fastened along a side of said core, said material extending laterally from said core, and a length of webbing positioned around said core and said material and fastened along a side of the core, said webbing extending laterally from said core on either side of said material.

10. A structure as claimed in claim 1, said transverse cross-section comprising a unitary integral form.

11. A structure as claimed in claim 1, said transverse cross-section being fabricated and comprising a continuous flange and a plurality of separate web sections welded to said flange at spaced positions along said flange.

12. A structure as claimed in claim 1, said transverse cross-section further including a further flange at the inner end of the web section extending laterally on each side at the inner end of the web section, and a further enclosed groove extending the length of the frame on each side of said web section at said further flange, a slot extending through a wall of each further groove to provide communication therewith.

13. A structure as claimed in claim 12, said further grooves positioned substantially at the junction of said further flange and said web-section.

14. A structure as claimed in claim 12, said transverse cross-section being fabricated and comprising continuous flanges at inner and outer ends, and a plurality of separate web sections welded at inner and outer ends to said flanges at spaced positions along said flanges.

15. A structure as claimed in claim 1, said transverse cross-section comprising an I shaped cross-section, including inner and outer flanges extending transversely at inner and outer ends of said web section, and including an enclosed groove at each internal corner at the junctions of said flanges and said web section.

16. A structure as claimed in claim 15, said fabric panels positioned in said grooves at said outer end of said web section, and including a further panel extending between each pair of adjacent frames, said further panels including a beaded edge along each side, the beaded edges being positioned in the grooves at said inner ends of said web section and the panel extending through said slots.

17. A structure as claimed in claim 16, said further panels including tensioning means extending the length of each panel and adapted to tension the panels after attachment to said frames.

18. A structure as claimed in claim 1, said transverse cross-section of a hollow box-like section having two spaced channel shaped webs in opposition; a flange portion at the inner edge and at the outer edge of each web, and an enclosed groove extending along each flange portion; the flange portions connected together to form a frame.

19. A structure as claimed in claim 18, said spaced channel shaped webs with said flange portions extending in short lengths, the lengths connected together in staggered overlapping relationship to form a frame.

20. A frame supported structure comprising:

means for providing a ground support;

a plurality of spaced frames extending up from said ground support means to torm a plurality of arched spans;

means for maintaining said frames in spaced relation to each other;

a plurality of fabric panels, each fabric panel extending between and attached to a pair of adjacent frames;

tensioning means extending lengthwise in said panel and adapted to tension said panel after attachment to said adjacent frames, comprising an inflatable portion attached to said panel and positioned between said adjacent frames, said inflatable portion having opposite sides attached to spaced portions of said panel such that, as said inflatable portion is inflated, said spaced portions are drawn together to tension said panel.

21. A structure as claimed in claim 20, said inflatable portion comprising pockets extending lengthwise in each panel, and means for inflating said pockets.

22. A structure as claimed in claim 21, including inflatable tubes in said pockets and means for inflating said tubes.

23. A structure as claimed in claim 21, including at least one pocket in each panel.

24. A structure as claimed in claim 21, including a plurality of pockets extending parallel to each other, in each panel.

25. A structure as claimed in claim 1, each frame comprising a plurality of straight sections joined by curved sections.

26. A structure as claimed in claim 25, including joints between curved sections and straight sections.

27. A structure as claimed in claim 25, said straight sections formed by unitary lengths and said curved sections being fabricated from flange lengths and individual separate web sections.

28. A structure as claimed in claim 1, including a lifting door structure at at least one end, said lifting door structure comprising a plurality of arched end frames and at least one end ground plate at each side, said end frames pivotally attached at their lower ends to said end ground plates, said end frames extending successively from horizontal up towards vertical, and segmental fabric panels extruding between said end frames.

29. A structure as claimed in claim 28, each said at least one end ground plate including a plurality of pivot positions extending inward parallel to the span of said spaced frames, the lower ends of said end frames positioned successively inward.

30. A structure as claimed in claim 29, the end frame extending horizontally having its lower ends pivotally attached to the innermost pivot position, each succeeding frame being pivotally attached at the next successively outerward pivot position.

31. A structure as claimed in claim 28, said at least one end ground plate comprising a plurality of ground plates extending in a direction normal to the span of said spaced frames and positioned immediately adjacent to each other.

32. A structure as claimed in claim 28, including means for raising said end frames to open said one end.

33. A structure as claimed in claim 22, said means for raising said end frames including at least one winch mounted on a frame and at least one cable extending from said winch to said end frames.

34. A structure as claimed in claim 1, including at least one door hinged about a vertical axis, at an end of said structure.

35. A method of erecting a frame supported structure, comprising;

positioning a plurality of frame supports in two parallel rows, the frame supports being at predetermined relative positions and spacings on a ground surface;

fastening the frame supports immovably to the ground surface;

pivotally attaching a plurality of arched frames at their ends to said frame supports, said frames being at substantially ground level and having their ends spaced by a predetermined distance equal to said predetermined spacing;

pivotally attaching rigid spacers having a length equal to said predetermined distance between adjacent frames such that said adjacent frames, rigid spacers and frame supports define articulated parallelograms in which said frames remain parallel when pivoted upward from said ground surface;

pulling said frames upward from the ground surface with said frames remaining parallel to each other;

positioning fabric panels between each pair of adjacent frames by sliding beaded edges on each side of a panel through grooves in said frames;

tensioning said panels when in position.

36. The method of claim 35, including positioning a bottom spacer between each pair of adjacent ground plates and attaching said bottom spacers to said ground plates.

37. The method of claim 35, including positioning said fabric panels in an outer series of grooves, and positioning further fabric panels between each pair of adjacent frames by sliding beaded edges on each side of a further panel through an inner series of grooves in said frames.

38. The method of claim 35, including positioning a rope in each of said grooves in each of said frames before said frames are pulled upward; attaching ends of panels to said ropes; and positioning said panels by pulling said ropes and said beaded edges of said panels through said grooves after said frames have been pulled upward to an erected position.

39. The method of claim 34, wherein tensioning of said panels is obtained by inflating inflatable members extending spanwise in said panels.

40. The method of claim 39, wherein tensioning is obtained by inflating tubes positioned in pockets extending spanwise in said panels.

41. The method as claimed in claim 35, including attaching said cross-bracing wires, extending in one direction, to said frames before pulling the frames upward.

42. The method of claim 41 including attaching cross-bracing wires extending in the other direction to said frames at one end of each wire before pulling the frames upward, and attaching the other end to a frame when said frames are in the erected position.

43. The method of claim 42 including tightening the cross-bracing wires where said frames are in the erected position.

* * * * *